US006126002A

United States Patent [19]

Brown et al.

[11] Patent Number: 6,126,002

[45] Date of Patent: Oct. 3, 2000

[54] CARTON/PAD PACKING ASSEMBLY FOR A WATER HEATER

[75] Inventors: James W. Brown, Louisville, Ky.; Willie E. Smith, Greenville, Ala.; Edward L. Spraley, Southside, Ala.; Jeffrey M. Haney, Montgomery, Ala.

[73] Assignee: Rheem Manufacturing Company, New York, N.Y.

[21] Appl. No.: 09/452,894

[22] Filed: Dec. 1, 1999

[51] Int. Cl.[7] ..... B65D 19/06; B65D 81/05

[52] U.S. Cl. ..... 206/320; 53/468; 206/485; 206/523; 206/598; 229/199.1

[58] Field of Search ..... 206/320, 386, 206/446, 485, 523, 586–592, 594; 229/199, 199.1; 53/468, 471

[56] References Cited

U.S. PATENT DOCUMENTS

| | | | |
|---|---|---|---|
| 2,321,063 | 6/1943 | Bohnke | 206/320 |
| 2,745,590 | 5/1956 | Herzog et al. | 229/23 |
| 2,774,474 | 12/1956 | Phillips | 206/65 |
| 2,804,253 | 8/1957 | Brandy | 229/199.1 |
| 2,818,972 | 1/1958 | Claus | 206/386 |
| 3,145,901 | 8/1964 | Gile | 229/23 |
| 3,204,385 | 9/1965 | De Remer et al. | 53/27 |
| 3,294,306 | 12/1966 | Areddy | 229/23 |
| 3,372,855 | 3/1968 | Smith | 229/199.1 |
| 3,494,535 | 2/1970 | Acker | 229/14 |
| 3,654,875 | 4/1972 | Vik | 108/51 |
| 3,752,087 | 8/1973 | Finke | 108/59 |
| 4,019,635 | 4/1977 | Boots | 206/386 |
| 4,050,605 | 9/1977 | Flanders | 220/4 F |
| 4,244,471 | 1/1981 | Plante | 206/586 |
| 4,253,569 | 3/1981 | O'Connor et al. | 206/391 |
| 4,760,915 | 8/1988 | Boets et al. | 206/303 |
| 4,955,474 | 9/1990 | Mattingly et al. | 206/320 |
| 5,096,112 | 3/1992 | Grigsby | 206/599 |
| 5,143,283 | 9/1992 | Lancaster | 206/320 |
| 5,275,279 | 1/1994 | Grigsby | 206/586 |
| 5,307,928 | 5/1994 | Bishop | 206/320 |
| 5,395,007 | 3/1995 | Householder et al. | 220/429 |
| 5,520,121 | 5/1996 | Schubart et al. | 108/57.1 |
| 5,588,373 | 12/1996 | Bacskay | 108/55.3 |
| 5,704,487 | 1/1998 | Taravella et al. | 206/596 |
| 5,862,911 | 1/1999 | Phillips, II et al. | 206/320 |

*Primary Examiner*—Jim Foster
*Attorney, Agent, or Firm*—Konneker & Smith, P.C.

[57] ABSTRACT

A water heater is protectively packaged for shipment and handling by respectively inserting upper and lower end portions thereof in recesses in facing padded sides of upper and lower end assemblies having, on their opposite sides, spaced pluralities of parallel support rail members. The water heater and associated end assemblies are enclosed within a cardboard box having a vertical side wall portion spaced horizontally outwardly from the water heater, and vertically elongated reinforcing members extend along interior corner portions of the box between the upper and lower end assemblies and form therewith a vertical load path facilitating the stacking of water heaters packaged in this manner. The box has a closed upper end portion within which the upper end portion is disposed, and an open lower end portion having an opposing pair of downwardly projecting tabs which are removably secured to outer side portions of an outer pair of support rail members on the lower end assembly in a manner leaving the opposite ends of the support members exposed. By simply disconnecting the lower box tabs from their associated support rails, the box can be vertically removed to expose the water heater for field modification if necessary. The packaged water heater may be lifted using either a fork lift or a pair of conventional squeeze plates.

34 Claims, 6 Drawing Sheets

CARTON/PAD PACKING ASSEMBLY FOR A WATER HEATER

BACKGROUND OF THE INVENTION

The present invention generally relates to packaging apparatus and, in a preferred embodiment thereof, more particularly relates to a specially designed carton/pad packing assembly, and associated methods, for protecting a water heater during shipping and handling thereof.

Subsequent to its manufacture, a water heater is typically packaged for shipment from its manufacturing location, the packaging serving to protect the water heater during shipment and subsequent handling. A conventional method of packaging a water heater, which normally has a vertically oriented cylindrical shape, is to simply place it in a cardboard box which closely surrounds it in a manner such that the four vertical side walls of the box touch or are closely adjacent the vertical side surface of the packaged water heater, and the upper and lower ends of the box are closely adjacent the top and bottom ends of the packaged water heater.

While this traditional approach to packaging a water heater is widely used and constitutes a simple and relatively low cost packaging method, it carries with it several well known problems, limitations and disadvantages. For example, in a typical line of water heaters the overall diameters vary. Thus, for each water heater of a different diameter a different size packaging box must be provided.

Additionally, a considerable amount of care must typically be exercised to avoid damage to the packaged water heater during handling thereof. For example, fork lifts are often used to move the packaged water heaters from place to place. If the packaged water heater is not carefully tilted to allow the fork lift blades to pass under it, the tips of the fork lift blades can easily be driven through the box and dent the water heater therein. Furthermore, this type of conventional packaging prevents the use of squeeze plates to lift and move the packaged water heater since the horizontally movable squeeze plates could also easily dent the packaged water heater. Another limitation associated with this conventional water packaging technique is that it does not provide the ability to vertically stack the packaged water heaters, and thereby requires more storage floor space for a given number of packaged water heaters.

As can be readily seen from the foregoing, a need exists for improved water heater packaging apparatus and associated methods which eliminate or at least substantially reduce the above-mentioned problems, limitations and disadvantages commonly associated with conventional water heater packaging apparatus and methods of the type generally described above. It is to this need that the present invention is directed.

SUMMARY OF THE INVENTION

In carrying out principles of the present invention, in accordance with a preferred embodiment thereof, an item, representatively an electric water heater, is protected from damage during shipping and associated handling thereof utilizing specially designed packaging apparatus and associated methods.

In its preferred embodiment, the packaging apparatus includes a container, preferably a rectangularly cross-sectioned cardboard box, configured to receive the water heater or other item in a horizontally outwardly spaced relationship therewith, the container having a vertical side wall portion, open upper and lower ends, and a closure portion associated with its upper end and positionable to selectively cover and uncover it. A plurality of vertically elongated reinforcing members are spaced around and extend along the vertical side wall portion of the container, and are representatively received within interior corner portions of the box.

The packaging apparatus further includes upper and lower end assemblies having (1) padded first side portions with recesses configured to complementarily receive upper and lower end portions of the item, and (2) opposite second side portions along which spaced pluralities of parallel support rail members, including pairs of outer side rail members, extend.

The upper end assembly is placeable, second side up, in the upper container end with upper end portions of the reinforcing members engaging the upper end assembly, and the closure portion being closeable over the upper end assembly. The lower end assembly is placeable, first side up, in the open lower container end in a manner such that lower end portions of the reinforcing members engage the lower end assembly, bottom end portions of the container outwardly overlie the lower end assembly and may be removably secured thereto, and opposite end portions of the support rail members of the lower end assembly are exposed at the lower end of the container and define fork lift blade insertion openings therebetween.

Representatively, the bottom end portions of the container are an opposing pair of tabs projecting downwardly from the open lower end of the container and being positionable to be removably secured to vertical side portions of the pair of outer side rail members in the lower end assembly.

Preferably, notches are formed in the padded first side portions of the upper and lower end assemblies and are respectively configured to receive upper and lower end portions of the interior container reinforcing members. Each of the notches is horizontally aligned with an end portion of one of the outer side rail members, and the reinforcing member end portion received by the notch is anchored to the outer side rail member end portion, representatively by fasteners such as screws. In this manner, a vertical load path is created that extends between support rail members on the upper end assembly and support rail members on the lower end assembly through the reinforcing members, thereby facilitating the stacking of the packaged water heaters or other items.

According to another feature of the invention, the recesses in the padded first side portions of the upper and lower end assemblies are outwardly bounded by sections of the padded first side portions that may be selectively removed to provide such recesses with larger but similarly shaped peripheries. Each recess representatively has a periphery lying in a circular path, each padded first side portion has an inner layer and an outer layer with the recesses being formed in the outer layers, and each of the outer layers has at least one perforation line formed therein which is parallel to and spaced horizontally outwardly of the periphery of the recess in the outer layer. In this manner, portions of the padded first side portions of the end assemblies may be simply torn out to permit the padded first side portion recesses to accommodate top and bottom end portions of larger diameter water heaters.

In accordance with yet another feature of the invention, when a water heater is to be packaged, the packaging apparatus further comprises an indentation formed in the padded first side portion of the lower end assembly and configured to press-fittingly and removably receive a junction box operatively connectable to the water heater after it is removed from the packaging apparatus.

DETAILED DESCRIPTION

Figure 1:
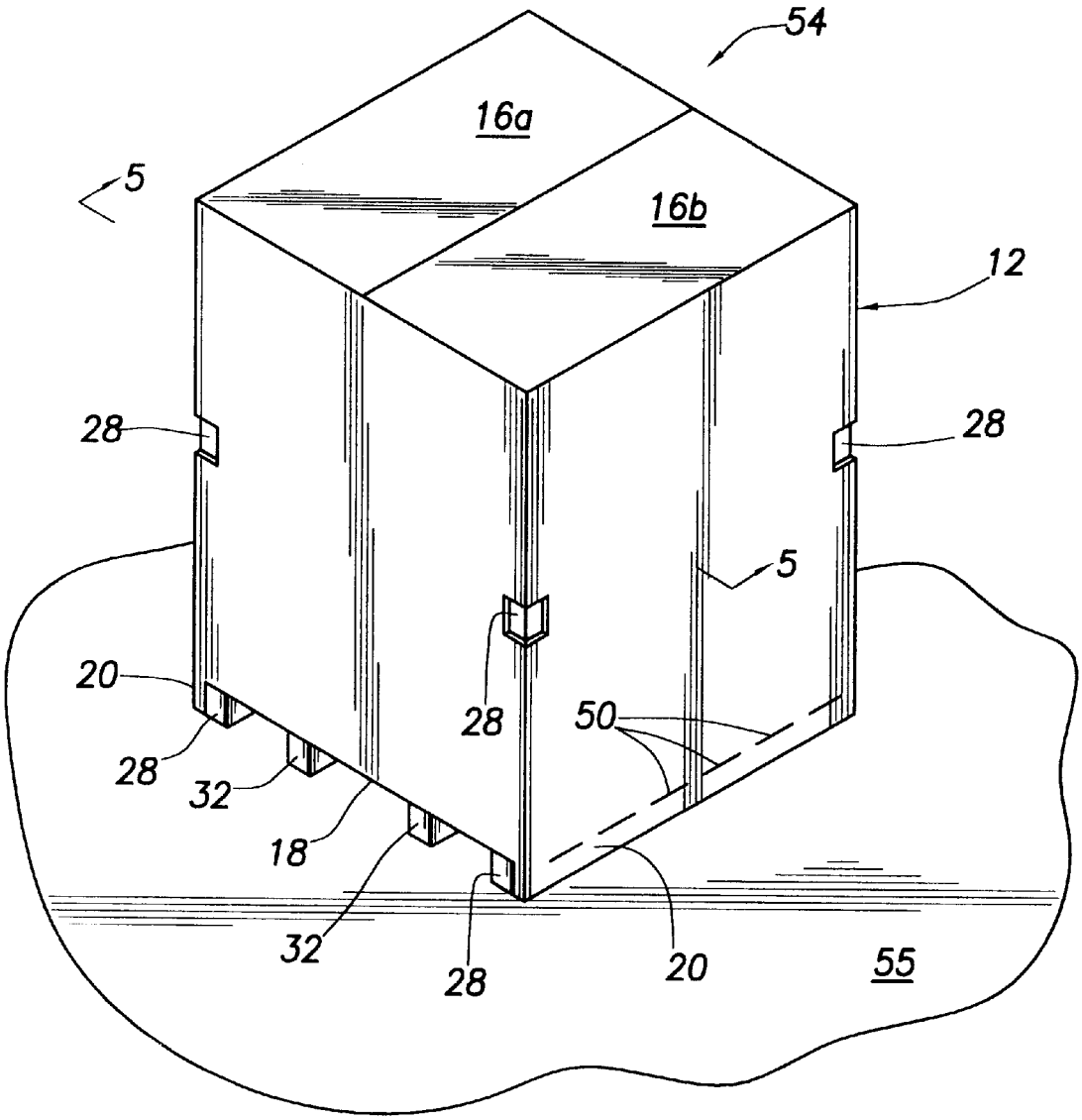
FIG. 1 is a perspective view of a packaged water heater embodying packaging principles of the present invention.

As illustrated in FIGS. 1–5, this invention provides a unique packaging structure for a water heater 10 (see FIGS. 2A, 3 and 5) which protects it from shipping and handling damage. Water heater 10 is representatively an electric, light duty commercial water heater, but could alternatively be a water heater of a variety of other types. While the packaging structure of the present invention is representatively shown as being utilized to protect a water heater during shipping and handling, it will be readily apparent to those of skill in the packaging art that it could alternatively be utilized to advantage in conjunction with a wide variety of other nonwater heater items.

The packaging structure includes a container, representatively in the form of a rectangular cardboard box 12 having an open top end 14 with four flaps 16*a*–16*d* secured thereto, and an open lower end 18 having two shorter opposite tabs 20 that depend therefrom. Perforated vertical corner areas 22 of the box may be punched inwardly (see FIG. 2B) to form interior corner sleeves 24 for later described purposes. The packaging structure further includes identical upper and lower end assemblies 26*a*,26*b* having generally rectangular configurations, and four vertically elongated reinforcing members in the form of wooden corner support posts 28. Each end assembly 26*a*,26*b* has, on one side thereof, four wooden support rail members 32, including two outer support rail members 32*a*, suitably secured in a spaced apart parallel relationship to four transversely extending support rail members 33 which are also in a spaced apart parallel relationship. While the end assemblies 26*a*,26*b* are illustratively identical, additional support rail members 33*a* (shown in phantom in FIG. 4) may be secured to the outer sides of the support rails 32 on the bottom end assembly 26*b* to further increase its structural strength.

on the other side of each end assembly 26*a*,26*b* are four generally rectangular pad sections 34 formed of a resilient foam material 36, representatively polyethylene. Pad sections 34 are secured to corner portions of the outer side of a generally rectangular pad member 38 also formed from a resilient foam material, also representatively polyethylene, having a lesser density than the pad sections 34. The inner side of the pad member 38 is suitably secured to the support rail members 33. Corner notches 40 are formed in the pad sections 34,38 and are aligned as shown with the outer end faces of the outer side rail members 32*a*. The corner-oriented pad sections 34 each have an arcuate indentation 42 formed therein and having a curvature identical to that of the vertical side wall of the water heater 10. Arcuate perforation lines 44 and 46 are formed horizontally outwardly of and parallel to each indentation 42.

Vertical indentations 47 are formed in two diagonally opposite ones of the foam pad sections 34, with a junction box 48 (which is operatively securable to the water heater 10 when it is unpacked) being removably press-fitted into the indentation 47 on one of the lower pad sections 34. This firmly secures the junction box 48 within the packaging apparatus to keep the junction box from moving around within the packaging structure during shipment and handling of the water heater 10 and potentially scratching or denting the packaged water heater. A central circular clearance opening 49 is formed in the pad portion 38 of each of the end assemblies 26*a*,26*b*.

Figure 2A:
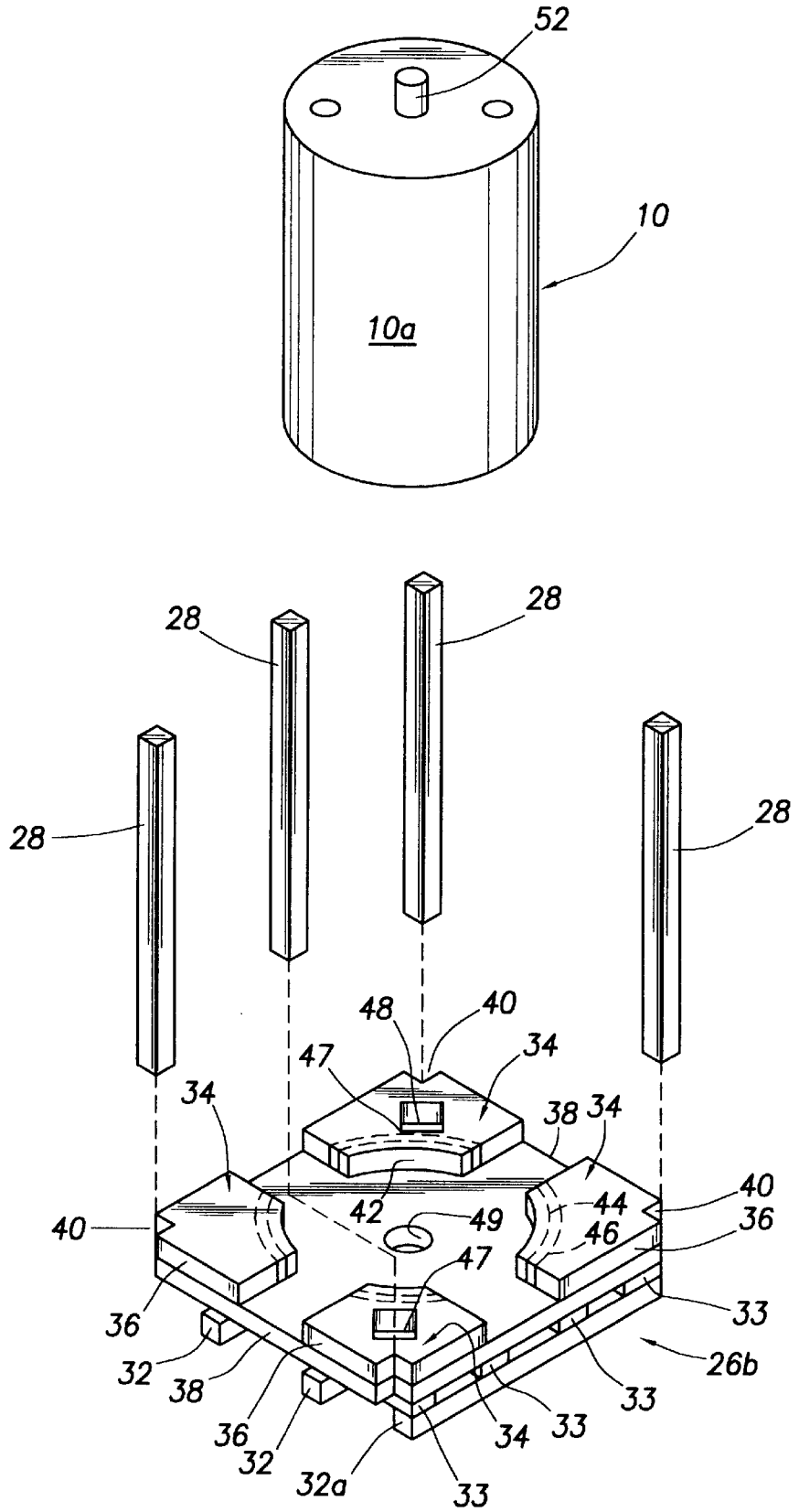
FIG. 2A is an exploded perspective view of a lower portion of the packaging apparatus shown in FIG. 1, together with the water heater.
Figure 2B:
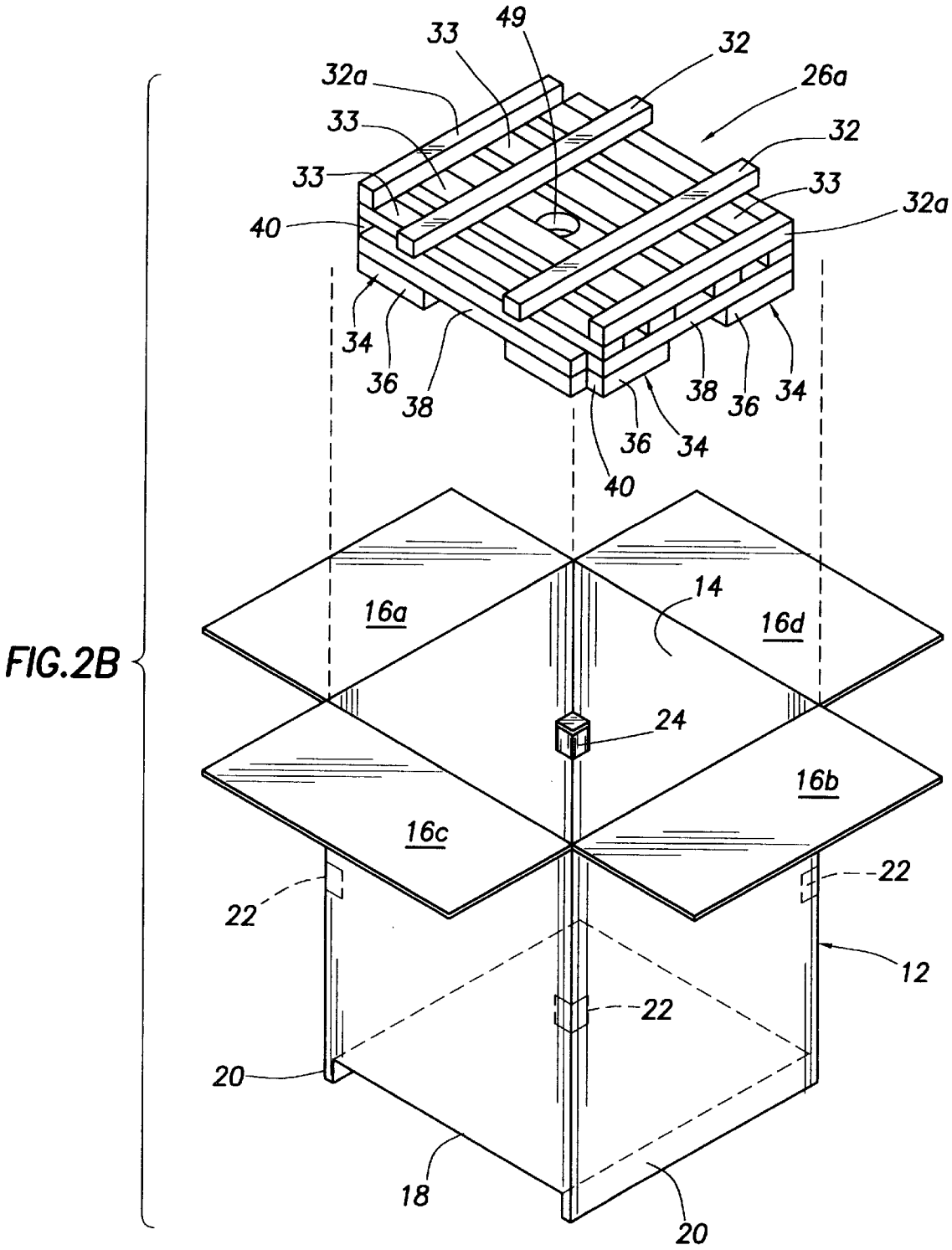
FIG. 2B is an exploded perspective view of a container portion of the packaging apparatus and an upper end assembly used in the packaging apparatus.
Figure 3:
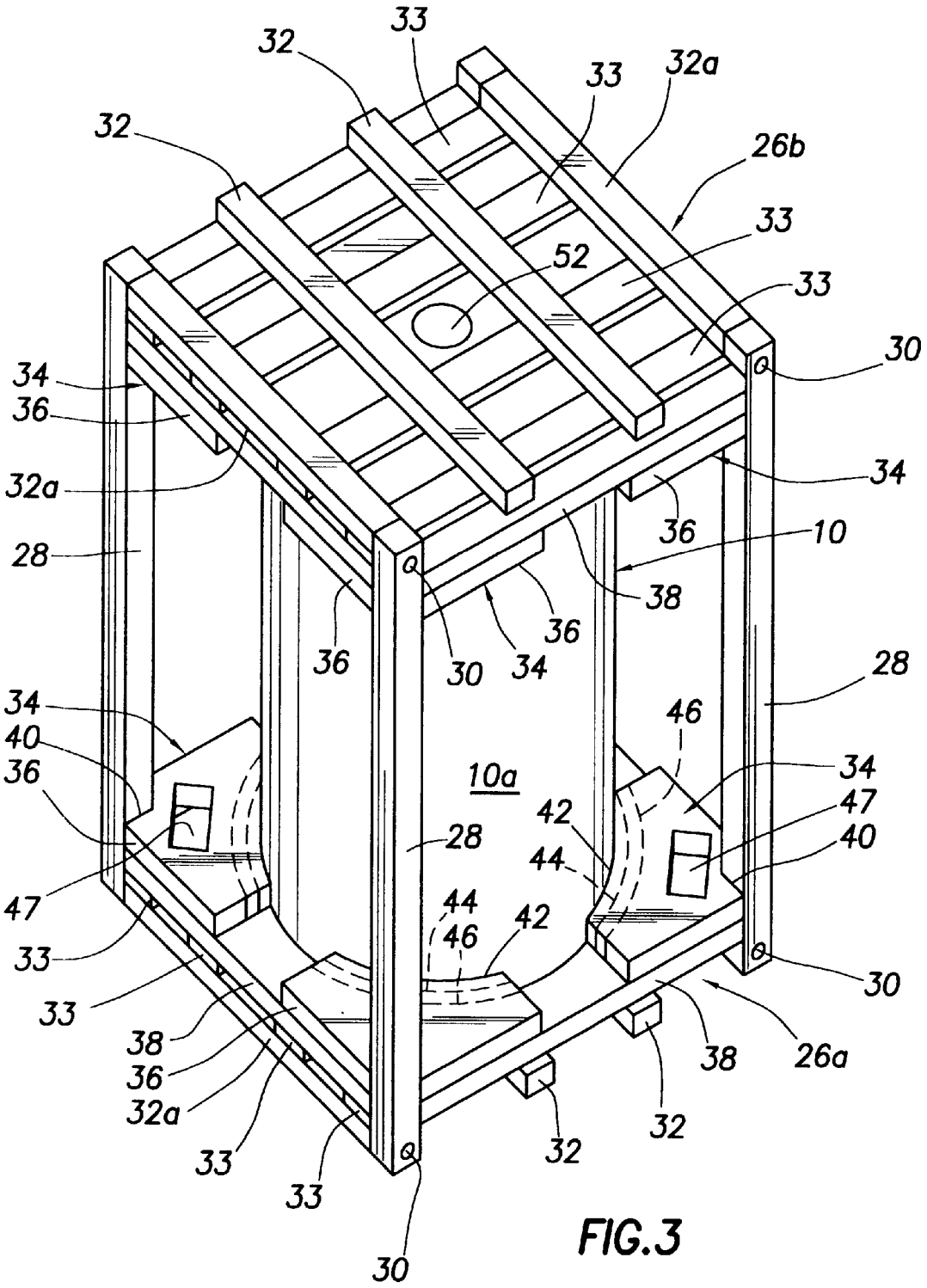
FIG. 3 is a perspective view of the packaged water heater with the container portion of the packaging apparatus having been removed for illustrative purposes.
Figure 4:
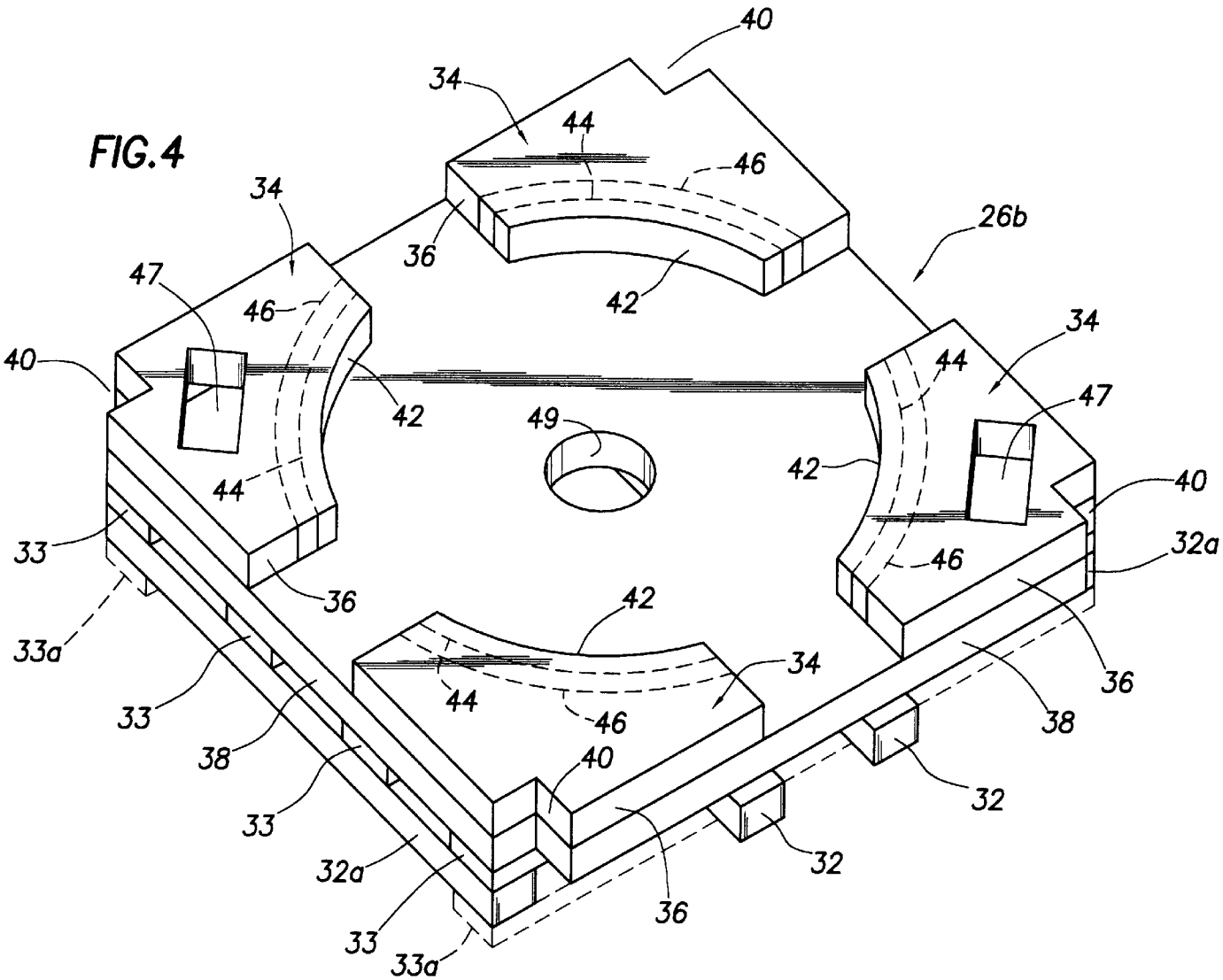
FIG. 4 is an enlarged scale perspective view of a lower end assembly used in the packaging apparatus.

With reference now to FIGS. 2A–3, to protectively pack the water heater 10 for shipment and storage, a bottom end portion of the water heater 10 is lowered onto a central portion of the pad section 38 of the lower end assembly 26*b* so that the bottom water heater end portion is snugly circumscribed by the vertical surfaces of the indentations 42 in the corner pad sections 34. The four vertical support posts 28 are extended through the interior box sleeves 24 and lower end portions of the posts 28 are positioned in the corner notches 40 on the lower end assembly 26*b* and anchored to the opposite end surfaces of the outer support rail members 32*a* with suitable fasteners such as screws 30 (see FIG. 3).

With its rails 32 facing upwardly, the upper end assembly 26*a* is placed atop the upper end of the water heater 10 to cause upper end portions of the vertical posts 28 to enter the corner notches 40 of the upper pad sections 34, and a temperature and pressure relief valve structure 52 on the upper end of the water heater 10 (see FIGS. 3 and 5) to pass upwardly through the central clearance hole 49 in pad 38 of the upper end assembly 26*a*. The upper ends of the support posts 28 are anchored to the facing end portions of the outer side rails 32*a* using screws 30 (see FIG. 3)

To complete the protective packaging of the water heater 10, the lower end tabs 20 on the box 12 (see FIG. 1) are suitable anchored, as with staples 50, to sides of the outer two rail members 32*a* on the lower end assembly 26*b*. Additionally, the upper end flaps 16*a*–16*d* of the box 12 are folded inwardly and suitable secured to the upper rails 32, such as by gluing or stapling.

Figure 5:
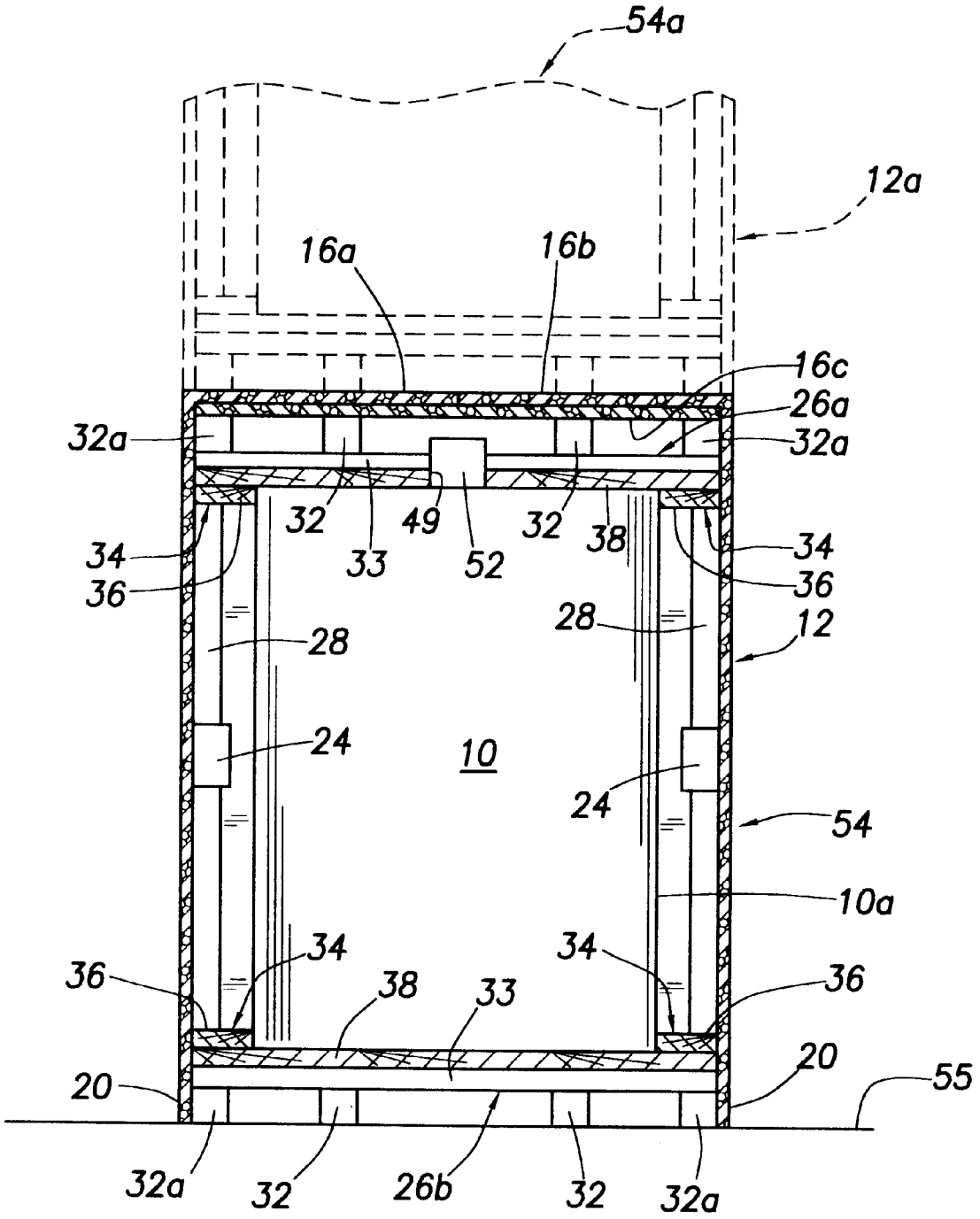
FIG. 5 is an enlarged scale cross-sectional view through the packaged water heater taken along line 5—5 of FIG. 1.

The finished packaged water heater assembly 54 shown in FIG. 1 may be picked up from the floor 55 using either a fork lift (whose blades may be inserted into the exposed openings between the ends of the bottom rails 32) or by using conventional squeeze plates positioned on opposite vertical sides of the box 12. As can be seen in FIG. 5, the vertical side surface 10*a* of the water heater 10 is spaced inwardly from the vertical sides of the box 12. Coupled with the foam pad support of upper and lower end portions of the water heater 10, this provides substantial protection for the water heater as compared to the conventional packaging method of simply placing a water heater closely within a cardboard shipping box.

The use of the vertical corner support posts or reinforcing members 28 adds desirable rigidity to the overall packaging, and additionally facilitates the vertical stacking of the packaged water heaters (see, e.g., the packaged water heater assembly 54*a* shown in phantom and stacked atop the underlying assembly 54 in FIG. 5). Specifically, as can best be seen in FIG. 5, a vertical stacking load path is created in the packaging structure of the packaged water heater assembly 54 from the outermost pair of its upper support rail members 32*a* to the outermost pair of its lower support rail members 32*a* via its vertical support posts 28 which are anchored to these top and bottom outer side support rail members 32*a*.

Another advantage provided by the unique packaging structure of the present invention is its ability to accommodate water heaters having the different diameters simply by making a minor modification to the pad sections 34 of the upper and lower end assemblies 26*a* and 26*b*. Specifically, it can be seen that by simply tearing out the arcuate pad sections disposed between the arcuate surfaces 42 and the perforation lines 44, the upper and lower ends of a larger diameter water heater can be complementarily received in the resulting larger indented areas in the pad sections 34. Similarly, by additionally tearing out the arcuate pad sections disposed between the arcuate perforation lines 44 and 46, upper and lower end portions of a still larger diameter water heater may be complementarily received in the resulting larger indentations in the pad sections 34.

An additional benefit of the packaging structure of the present invention in its illustrated preferred embodiment is that, as mentioned above, the upper and lower end assemblies 26*a*,26*b* are representatively of identical constructions and configurations. Accordingly, the number of packaging parts that must be inventoried is reduced, and the possibility that the water heater packaging apparatus will be incorrectly assembled is also reduced.

With reference to FIG. 1, as previously mentioned herein the box 12 is removably secured to the outermost pair of the bottom support rail members 32*a* by securement structures such as the representatively illustrated staples 50. This permits the packaged water heater 10 to be rapidly exposed for field modification (such as rewiring it to change from single phase electrical operation to three phase electrical operation or vice versa) by simply removing the staples 50 and lifting the box 12 away from the water heater 10. After such field modification is completed, the modified water heater may be quickly repackaged by simply lowering the box 12 down over the water heater and restapling the lower box end tabs 20 to their associated support rails 32*a*.

The foregoing detailed description is to be clearly understood as being given by way of illustration and example, the spirit and scope of the present invention being limited solely by the appended claims.

What is claimed is:

1. Packaging apparatus for protecting an item during shipping and handling thereof, comprising:

a container configured to receive the item in a horizontally outwardly spaced relationship therewith, said container having a vertical side wall portion, open upper and lower ends, and a closure portion associated with said upper end and positionable to selectively cover and uncover it;

a plurality of vertically elongated reinforcing members spaced around and extending along said vertical side wall portion of said container; and upper and lower end assemblies having (1) padded first side portions with recesses configured to complementarily receive upper and lower end portions of the item, and (2) opposite second side portions along which spaced pluralities of parallel support rail members, including pairs of outer side rail members, extend, said upper end assembly being placeable, second side up, in said upper container end with upper end portions of said reinforcing members engaging said upper end assembly, and said closure portion being closeable over said upper end assembly, and said lower end assembly being placeable, first side up, in said open lower container end in a manner such that lower end portions of said reinforcing members engage said lower end assembly, bottom end portions of said container outwardly overlie said lower end assembly and may be removably secured thereto, and opposite end portions of said support rail members of said lower end assembly are exposed at said lower end of said container.

2. The packaging apparatus of claim 1 wherein said bottom end portions of said container are an opposing pair of tabs projecting downwardly from said open lower end of said container and being positionable to be removably secured to vertical side portions of the pair of outer side rail members in said lower end assembly.

3. The packaging apparatus of claim 2 wherein:

said container is a cardboard box, and said closure portion is defined by foldable flaps carried on said open upper end of said container.

4. The packaging apparatus of claim 1 further comprising notches formed in said padded first side portions of said upper and lower end assemblies and configured to receive end portions of said reinforcing members.

5. The packaging apparatus of claim 4 wherein:

said container has a generally rectangular cross-section along its vertical length, and said reinforcing members longitudinally extend along interior corner portions of said container.

6. The packaging apparatus of claim 4 wherein each of said notches is horizontally aligned with an adjacent portion of one of said support rail members and opposite ends of said reinforcing members are anchored to adjacent portions of said support rail members in a manner creating a vertical load path extending between support rail members on said upper end assembly and support rail members on said lower end assembly through said reinforcing members.

7. The packaging apparatus of claim 1 wherein said recesses in said padded first side portions of said upper and lower end assemblies are outwardly bounded by sections of said padded first side portions that may be selectively removed to provide said recesses with larger but similarly shaped peripheries.

8. The packaging apparatus of claim 7 wherein each of said recesses has a periphery lying in a circular path.

9. The packaging apparatus of claim 7 wherein:

each of said padded first side portions has an inner layer and an outer layer, and said recesses are formed in said outer layers.

10. The packaging apparatus of claim 9 wherein each of said outer layers has at least one perforation line formed therein which is parallel to and spaced horizontally outwardly of the periphery of the recess in the outer layer.

11. The packaging apparatus of claim 1 wherein each of said upper and lower end assemblies has a central clearance hole formed therein and extending between said first and second side portions thereof.

12. The packaging apparatus of claim 1 wherein:

the item is a water heater, and said packaging apparatus further comprises an indentation formed in said padded first side portion of said lower end assembly and configured to press-fittingly and removably receive a junction box operatively connectable to the water heater after it is removed from said packaging apparatus.

13. Packaged apparatus comprising:

an item needing protection during shipping and handling; and protective packaging apparatus including:

a container receiving said item in a horizontally outwardly spaced relationship therewith, said container having a vertical side wall portion, a closed upper end, and an open lower end, a plurality of vertically elongated reinforcing members spaced around and extending interiorly along said vertical side wall portion of said container, said reinforcing members having upper and lower ends, and upper and lower end assemblies respectively received in said upper and lower ends of said container and having (1) facing padded first side portions with recesses formed therein and complementarily receiving upper and lower end portions of said item, and (2) opposite second side portions along which spaced pluralities of parallel support rail members, including pairs of outer side rail members, extend, said upper and lower ends of said reinforcing members respectively engaging said upper and lower end assemblies, bottom end portions of said container outwardly overlying said lower end assembly and being removably secured thereto to permit said container to be upwardly moved to expose said item, and opposite end portions of said support rail members of said lower end assembly being exposed at said lower end of said container.

14. The packaged apparatus of claim 13 wherein said bottom end portions of said container are an opposing pair of tabs projecting downwardly from said open lower end of said container and being removably secured to vertical side portions of the pair of outer side rail members in said lower end assembly.

15. The packaged apparatus of claim 14 wherein said container is a cardboard box with inwardly folded flaps carried by and closing said upper end of said container.

16. The packaged apparatus of claim 13 further comprising notches formed in said facing padded first side portions of said upper and lower end assemblies and respectively receiving said upper and lower ends of said reinforcing members.

17. The packaged apparatus of claim 16 wherein:

said container has a generally rectangular cross-section along its vertical length, and said reinforcing members longitudinally extend along interior corner portions of said container.

18. The packaged apparatus of claim 16 wherein each of said notches is horizontally aligned with an adjacent portion of one of said support rail members and opposite end portions of said reinforcing members are received in said notches and anchored to said adjacent portions of said support rail members in a manner creating a vertical load path extending between support rail members on said upper end assembly and support rail members on said lower end assembly through said reinforcing members.

19. The packaged apparatus of claim 13 wherein said recesses in said padded first side portions of said upper and lower end assemblies are outwardly bounded by sections of said padded first side portions that may be selectively removed to provide said recesses with larger but similarly shaped peripheries.

20. The packaged apparatus of claim 19 wherein each of said recesses has a periphery lying in a circular path.

21. The packaged apparatus of claim 19 wherein:

each of said padded first side portions has an inner layer and an outer layer, and said recesses are formed in said outer layers.

22. The packaged apparatus of claim 21 wherein each of said outer layers has at least one perforation line formed therein which is parallel to and spaced horizontally outwardly of the periphery of the recess in the outer layer.

23. The packaged apparatus of claim 13 wherein each of said upper and lower end assemblies has a central clearance hole formed therein and extending between said first and second side portions thereof.

24. The packaged apparatus of claim 13 wherein said item is a water heater.

25. The packaged apparatus of claim 24 wherein:

said packaging apparatus further includes an indentation formed in said padded first side portion of said lower end assembly, and said packaged apparatus further comprises a junction box press-fittingly and removably received in said indentation and being operatively connectable to said water heater after it is removed from said packaging apparatus.

26. The packaged apparatus of claim 24 wherein:

said water heater has , on its upper end, an upwardly projecting temperature and pressure relief valve structure, and said upper end assembly has a central clearance hole formed therein and through which said temperature and pressure relief valve structure upwardly extends.

27. The packaged apparatus of claim 24 wherein said water heater is an electric water heater.

28. A method of packaging an item having spaced apart upper and lower end portions, said method comprising the steps of:

providing upper and lower end assemblies having (1) padded first side portions with recessed areas configured to complementarily receive said upper and lower end portions of said item, and (2) opposite second end portions along which spaced pluralities of parallel support rail members, including pairs of outer side rail members, extend;

respectively placing said upper and lower end portions of said item in said recessed areas of said first side portions of said upper and lower end assemblies;

supportingly positioning a spaced plurality of vertically elongated reinforcing members between said upper and lower end assemblies in a horizontally outwardly spaced relationship with said item; and enclosing said item and said reinforcing members with a container having an open lower end receiving and removably secured to said lower end assembly in a manner exposing the opposite ends of its support rail members, and a closed upper end enclosing said upper end assembly.

29. The method of claim 28 wherein:

said container has an opposing pair of tabs projecting downwardly from its open lower end, and said enclosing step is performed in a manner such that said tabs are removably secured to vertical side portions of said pair of outer side rail members on said lower end assembly.

30. The method of claim 28 wherein said enclosing step is performed using a cardboard box.

31. The method of claim 28 wherein:

said padded first side portions of said upper and lower end assemblies have notches therein, and said supportingly positioning step includes the step of respectively placing upper and lower end portions of said reinforcing members in said notches in said padded first side portions of said upper and lower end assemblies.

32. The method of claim 31 wherein said supportingly positioning step is performed in a manner creating a load patch extending from support rail members on said upper end assembly through said reinforcing members to support rail members on said lower end assembly.

33. The method of claim 28 wherein said item is a water heater.

34. The method of claim 33 wherein said method further comprises the steps of:

forming an indentation in said padded first side portion of said lower end assembly, and removably press-fitting a junction box into said indentation.

* * * * *